US006688479B2

(12) United States Patent
Nei

(10) Patent No.: US 6,688,479 B2
(45) Date of Patent: Feb. 10, 2004

(54) U-SHAPED CURTAIN ROD WITH PIVOTABLE CONNECTING ARMS

(76) Inventor: Shai-Wei Nei, 45-4, Fu-Hsing Hsiang, Fan-Pou Village, Changhua Hsien (TW)

( * ) Notice: Subject to any disclaimer, the term of this patent is extended or adjusted under 35 U.S.C. 154(b) by 52 days.

(21) Appl. No.: 10/095,941

(22) Filed: Mar. 13, 2002

(65) Prior Publication Data

US 2003/0173319 A1 Sep. 18, 2003

(51) Int. Cl.[7] ..... A47H 1/02

(52) U.S. Cl. ..... 211/105.2; 248/265; 211/86.01

(58) Field of Search ..... 211/105.2–105.4, 211/123, 175, 86.01; 160/330, 352; 16/94 DL, 90, 87 R, 87.4 R; 403/71, 87, 106–108, 84, 364, 408, 103, 104, 97, 99–101, 91, 92–94; 248/261, 262, 265, 251

(56) References Cited

U.S. PATENT DOCUMENTS

| | | | | | |
|---|---|---|---|---|---|
| 1,424,337 | A | * | 8/1922 | Boye | 211/105.2 |
| 2,617,537 | A | * | 11/1952 | Henley | 211/105.2 |
| 2,927,762 | A | * | 3/1960 | Owsiak | 248/262 |
| 3,213,273 | A | * | 10/1965 | Zagel | 362/431 |
| 4,378,071 | A | * | 3/1983 | Yakimicki | 211/105.4 |
| 4,635,889 | A | * | 1/1987 | Bell et al. | 248/265 |
| 4,754,504 | A | * | 7/1988 | Cellini | 211/105.2 |
| 4,757,778 | A | * | 7/1988 | Scaglia | 403/109 |
| 5,039,049 | A | * | 8/1991 | Niemi | 248/265 |
| 5,105,350 | A | * | 4/1992 | Tolman et al. | 248/295.1 |
| 5,421,551 | A | * | 6/1995 | LeClaire | 248/257 |
| 5,645,255 | A | * | 7/1997 | Parduhn | 248/214 |
| 5,661,942 | A | * | 9/1997 | Palmer | 52/653.2 |
| 5,700,102 | A | * | 12/1997 | Feleppa | 403/170 |
| 5,706,878 | A | * | 1/1998 | Guettler | 160/369 |
| 5,791,804 | A | * | 8/1998 | Cheng | 403/97 |
| 6,095,713 | A | * | 8/2000 | Doyle et al. | 403/97 |
| 6,101,675 | A | * | 8/2000 | Goldstein | 16/94 D |
| 6,135,403 | A | * | 10/2000 | Goldstein | 248/253 |
| 6,161,948 | A | * | 12/2000 | Hagen | 362/418 |
| 6,409,411 | B1 | * | 6/2002 | Crorey | 403/97 |
| 6,502,794 | B1 | * | 1/2003 | Ting | 248/362 |

FOREIGN PATENT DOCUMENTS

| | | | | |
|---|---|---|---|---|
| FR | 770527 | * | 9/1934 | 211/105.2 |
| NO | 51498 | * | 9/1932 | 211/105.2 |

* cited by examiner

*Primary Examiner*—Daniel P. Stodola
*Assistant Examiner*—Jennifer E. Novosad
(74) *Attorney, Agent, or Firm*—Bacon & Thomas, PLLC

(57) ABSTRACT

A U-shaped curtain rod mainly includes an adjustable rod formed from two telescoping hollow tubes; two knuckle joints connected to two outer ends of the adjustable rod, each of which being formed from two laterally symmetrical sets of a connecting arm and an adjusting block; and two mounting plates to which the knuckle joints are pivotally turnably connected. The two adjusting blocks of each knuckle joint are closely attached to each other by a screwing member extending through centered holes thereof, and are provided at contact surfaces with a plurality of radially extended adjusting teeth. By slightly loosening the screwing members, the two adjusting blocks of each knuckle joint could be turned relative to each other, allowing the two connecting arms to pivotally turn to positions closer to or away from a window to which the curtain rod is fixed.

6 Claims, 5 Drawing Sheets

U-SHAPED CURTAIN ROD WITH PIVOTABLE CONNECTING ARMS

FIELD OF THE INVENTION

The present invention relates to a U-shaped curtain rod, and more particularly to a U-shaped curtain rod that includes an adjustable rod and two knuckle joints pivotally turnably connected between the adjustable rod and two mounting plates fixed to, for example, two window jambs. Each of the knuckle joints includes two adjusting blocks that are closely attached to each other by a screwing member extended through centered holes provided on the adjusting blocks, and could be pivotally turned relative to each other by slightly loosening the screwing member. A plurality of radially extended adjusting teeth are provided on two contact surfaces of the two adjusting blocks to locate the latter to an adjusted position. When the adjusting blocks are pivotally turned, two connecting arms connected to outer ends of the adjusting blocks to separately connect to the mounting plate and the adjustable rod are pivotally turned relative to the mounting plate to a position closer to or away from the window as desired.

BACKGROUND OF THE INVENTION

A U-shaped curtain rod is frequently designed for fixing to window jambs above a kitchen sink, FIG. 1 is an exploded perspective view of a conventional U-shaped curtain rod that mainly includes an adjustable rod 10 and two mounting plates 20. The adjustable rod 10 includes two L-shaped tubes 11, two inner ends of which are integrally bent into two telescopic heads 12 for the two L-shaped tubes 11 to slidably connected to each other at these telescopic heads 12. An outer end of each L-shaped tube 11 is provided at upper and lower sides with two symmetrical long holes 13, and an engaging opening 14 is defined between the upper and the lower sides of each outer end. Each mounting plate 20 includes a fixing base 21 having two mounting holes 22 formed at predetermined positions thereon, and a support bracket 23 forward extended from an outer edge of the fixing base 21 at a right angle relative to the fixing base 21. The support bracket 23 includes a smoothly curved lower front corner to provide an engaging nose 24, and a retaining projection 25 upward extended from a predetermined point on an upper edge of the support bracket 23. The retaining projection 25 is adapted to engage with one of the long holes 13 on the outer ends of the L-shaped tubes 11.

FIG. 2 shows the manner of mounting the conventional U-shaped curtain rod to two window jambs. As shown, the two mounting plates 20 are attached to desired positions on the window jambs above a kitchen sink by threading screws through the mounting holes 22 on the fixing bases 21. Then, connect a curtain 30 to the two slidably connected L-shaped tubes 11 and adjust the telescopic heads 12 to obtain a desired overall length for the adjustable rod 10 to match with a distance between the two fixed mounting plates 20. The adjustable rod 10 is then connected to the mounting plates 20 by aligning and engaging two long holes 13 at upper sides of the outer ends of the two L-shaped tubes 11 with the upward extended retaining projections 25, and allowing the engaging noses 24 of the mounting plates 20 to slide into the engaging openings 14 to locate the whole support brackets 23 in the engaging openings 14 to firmly support the adjustable rod 10 at a desired position.

The above-described conventional U-shaped curtain rod has the following disadvantages:

1. The U-shaped adjustable rod 10 is formed from two L-shaped tubes slidably connected to each other at inner ends. The curtain 30 hung on the adjustable rod 10 is always located in front of the window jambs with a fixed distance between the curtain and the window. That is, the distance of the curtain 30 from the window is defined by the L-shaped tubes 11 and is not adjustable. The curtain 30 is therefore monotonously located in front of the window.
2. Since the distance between the curtain 30 and the window is fixed and could not be adjusted closer to the window, the curtain 30 tends to be wetted by slashed water when a user works at the sink. To avoid splashing water and wetting the curtain 30, the user would have to do work at the sink in a moderate and less efficient manner.

It is therefore desirable to develop an improved U-shaped curtain rod to eliminate drawbacks existing in the conventional U-shaped curtain rod.

SUMMARY OF THE INVENTION

A primary object of the present invention is to provide a U-shaped curtain rod having an adjustable rod that could be easily adjusted to a position closer to or away from a window as desired.

Another object of the present invention is to provide a U-shaped curtain rod having an adjustable rod that could be adjusted to a position closer to a window as desired, so as to avoid a curtain from being wetted by splashed water and allow a user to do works at a sink in a more efficient manner.

To achieve the above and other objects, the U-shaped curtain rod of the present invention includes an adjustable rod formed from two telescoping hollow tubes; two knuckle joints connected to two outer ends of the adjustable rod, each of which being formed from two laterally symmetrical sets of a connecting arm and an adjusting block; and two mounting plates to which the knuckle joints are pivotally turnably connected. The two adjusting blocks of each knuckle joint are closely attached to each other by a screwing member extending through centered holes thereof, and are provided at contact surfaces with a plurality of radially extended adjusting teeth to locate the two adjusting blocks at an adjusted position relative to each other. By slightly loosening the screwing members, the two adjusting blocks of each knuckle joint could be turned relative to each other, allowing the two connecting arms to pivotally turn to positions closer to or away from a window to which the curtain rod is fixed.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
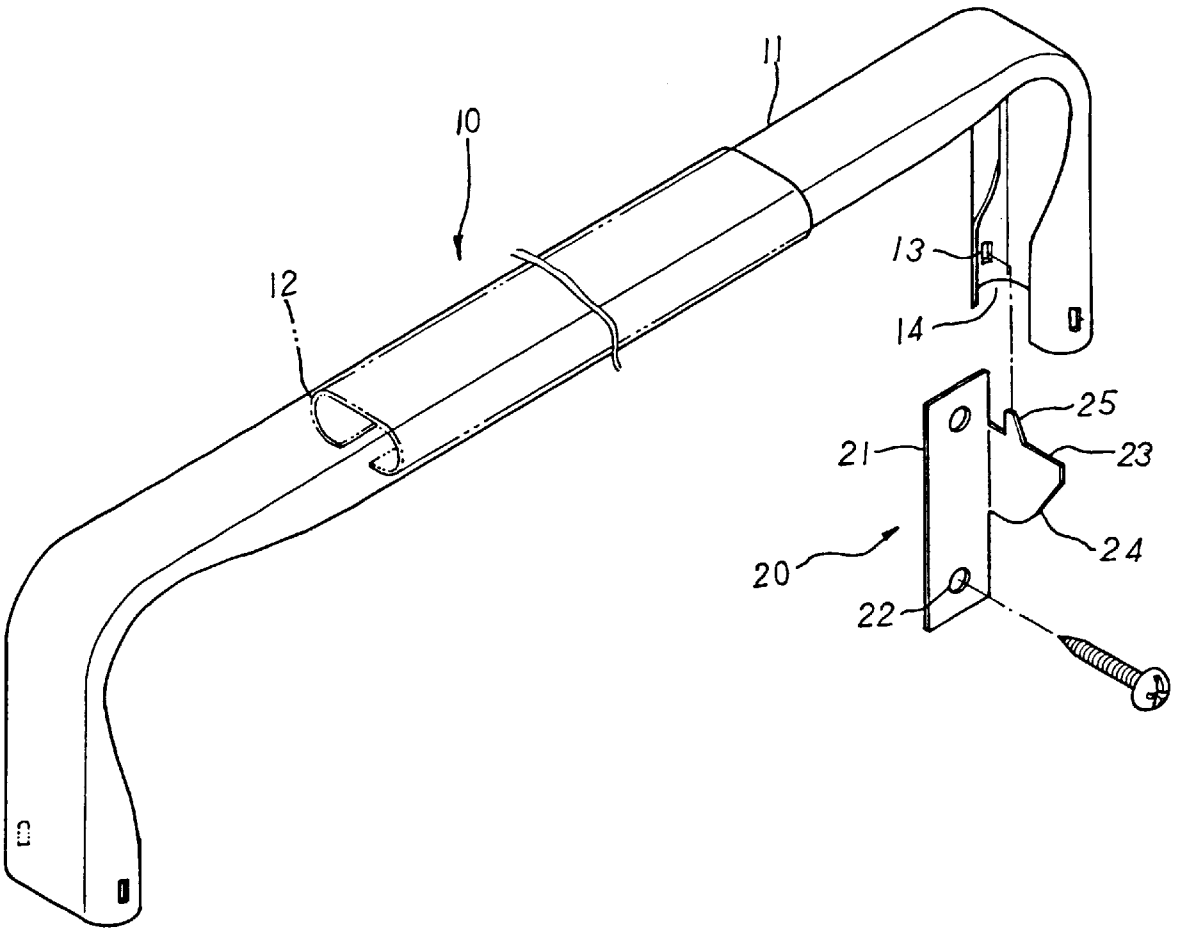
FIG. 1 PRIOR ART
FIG. 1 is a fragmentary exploded perspective view of a conventional U-shaped curtain rod.
Figure 2:
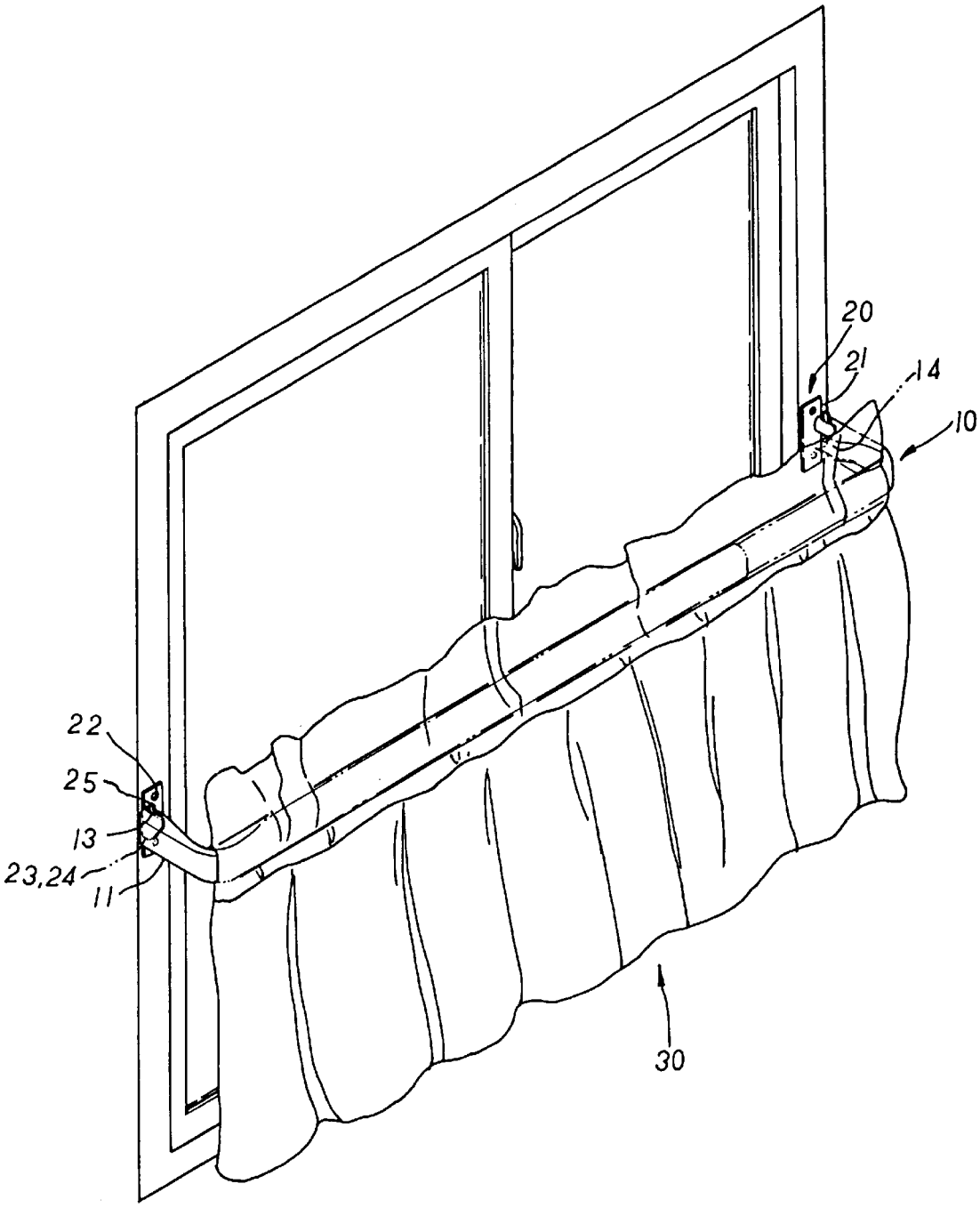
FIG. 2 PRIOR ART
FIG. 2 shows the conventional U-shaped curtain rod of FIG. 1 in an assembled state and mounted to window jambs.
Figure 3:
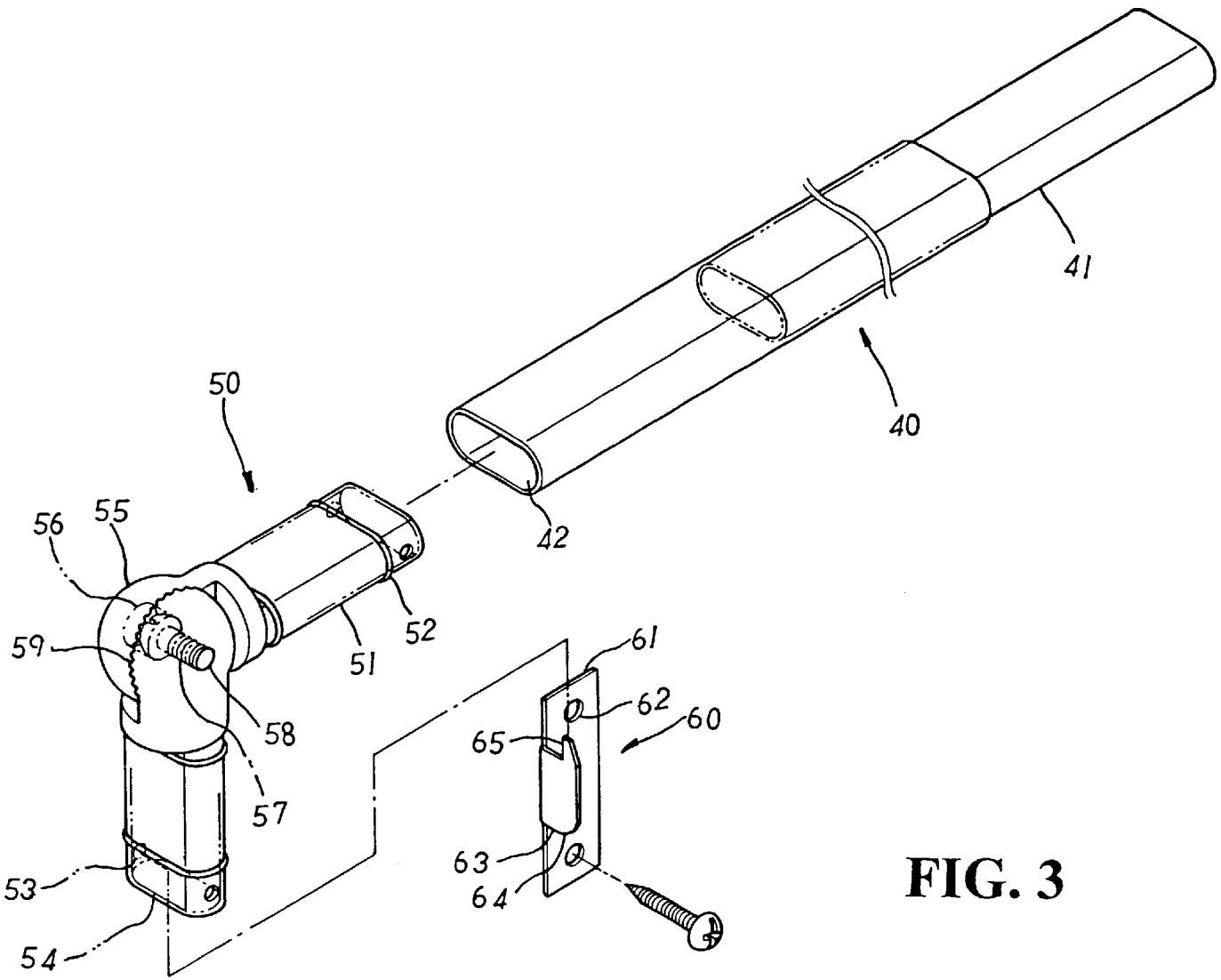
FIG. 3 is a fragmentary exploded perspective view of a U-shaped curtain rod according to the present invention.

Please refer to FIG. 3 that is a fragmentary exploded perspective view of a U-shaped curtain rod according to the present invention. The U-shaped curtain rod mainly includes an adjustable rod 40, two knuckle joints 50, and two mounting plates 60.

The adjustable rod 40 includes two telescoped (telescoping) oblong-sectioned hollow tubes 41 having predetermined lengths. Two outer open ends of the two tubes 41 provide two male connectors 42.

Each of the knuckle joints 50 includes laterally symmetrical hollow outer and inner connecting arms 51. Each of the connecting arms 51 is provided on an outer surface at predetermined positions with a plurality of elastic retaining rings 52, and at upper and lower sides near an outer end with two symmetrical round retaining holes 53. The outer end of each connecting arm 51 provides a female connector 54 adapted to tightly fit into the male connector 42 of the adjustable rod 40. The knuckle joint 50 also includes two substantially semispherical adjusting blocks 55 separately connected at outer ends to inner ends of the two connecting arms 51. A first one of the two adjusting blocks 55 is provided with a centered round hole 56 and a second one of the adjusting blocks 55 is provided with a centered internally threaded hole 57, such that the two adjusting blocks 55 can be closely and laterally symmetrically attached to each other at inner ends by threading a screwing member 58 through the round hole 56 into the threaded hole 57. And, the two adjusting blocks 55 are correspondingly provided at their contact surfaces with a plurality of radially extended adjusting teeth 59.

Each of the mounting plates 60 includes a fixing base 61 provided at predetermined positions with two mounting holes 62, and a support bracket 63 forward extended from one outer edge of the fixing base 61 at a right angle relative to the fixing base 61. A lower front corner of the support bracket 63 provides a smoothly curved engaging nose 64, and an upper front corner of the support bracket 63 provides an upward extended retaining projection 65 adapted to rotatably engage with the round retaining hole 53 on the connecting arm 51 of the knuckle joint 50.

Figure 4:
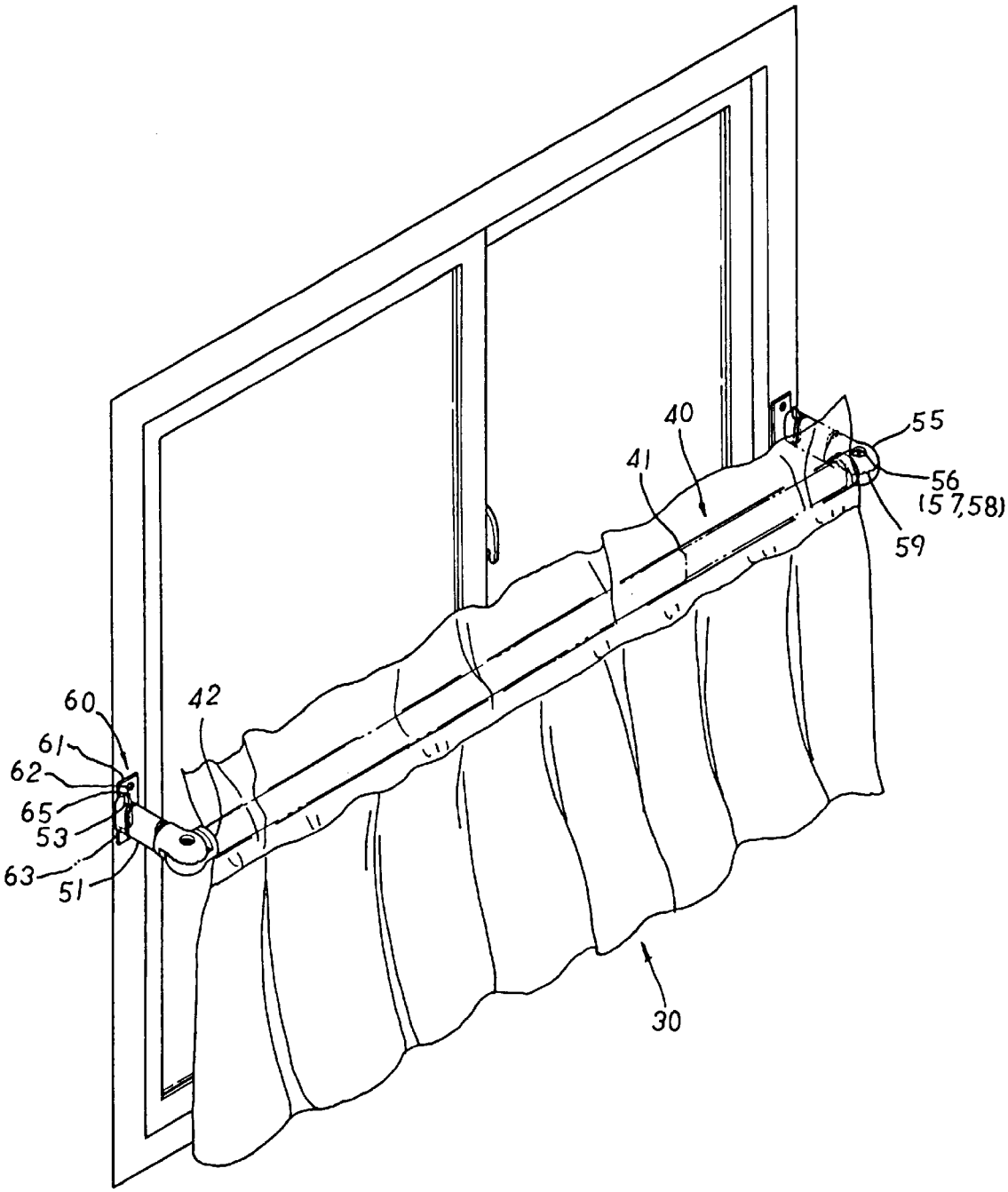
FIG. 4 is shows the U-shaped curtain rod of the present invention in an assembled state and mounted to window jambs.

Please refer to FIG. 4. The U-shaped curtain rod is usually designed for mounting to two jambs of a window frame above a kitchen sink. To do so, first attach the fixing bases 61 of the two mounting plates 60 to the window jambs at desired positions by screws extended through the mounting holes 62 into the window jambs. Then, connect a curtain 30 to the adjustable rod 40 before tightly fit two inner connecting arms 51 of the two knuckle joints 50 into the two male connectors 42 at two open ends of the adjustable rod 40. At this point, the elastic retaining rings 52 on the connecting arms 51 of the knuckle joints 50 are tightly pressed against inner wall surfaces of the male connectors 42. Thereafter, slide the two telescoped tubes 41 of the adjustable rod 40 relative to each other to obtain a desired overall length for the adjustable rod 40 to match with a distance between the two fixedly mounted mounting plates 60. Finally, the adjustable rod 40 with the knuckle joints 50 fitted to two ends thereof is to be connected to and between the two mounting plates 60. To do so, first align the female connectors 54 of the other two outer connecting arms 51 of the knuckle joints 50 with the two mounting plates 60 already fixed on the window jambs, and then engage the retaining holes 53 at upper sides of the female connectors 54 of the two outer connecting arms 51 with the upward extended retaining projections 65 on the support brackets 63 of the mounting plates 60. This would allow the two knuckle joints 50 and accordingly the adjustable rod 40 connected to the knuckle joints 50 to move downward along the curved engaging noses 64 for the two support brackets 63 to completely locate in the female connectors 54 of the two outer connecting arms 51 and hold the knuckle joints 50 to the mounting plates 60. Thereafter, the two adjusting blocks 55 of each knuckle joint 50 are turned relative to each other by adequately loosening the screwing member 58 in the round hole 56 and the threaded hole 57 for the adjusting teeth 59 on the contact surfaces of the two adjusting blocks 55 to engage with one another at desired positions. The screwing member 58 is then tightened again to mesh with the internally threaded hole 57 to hold the two adjusting blocks 55 in place to complete the mounting of the U-shaped curtain rod.

Figure 5:
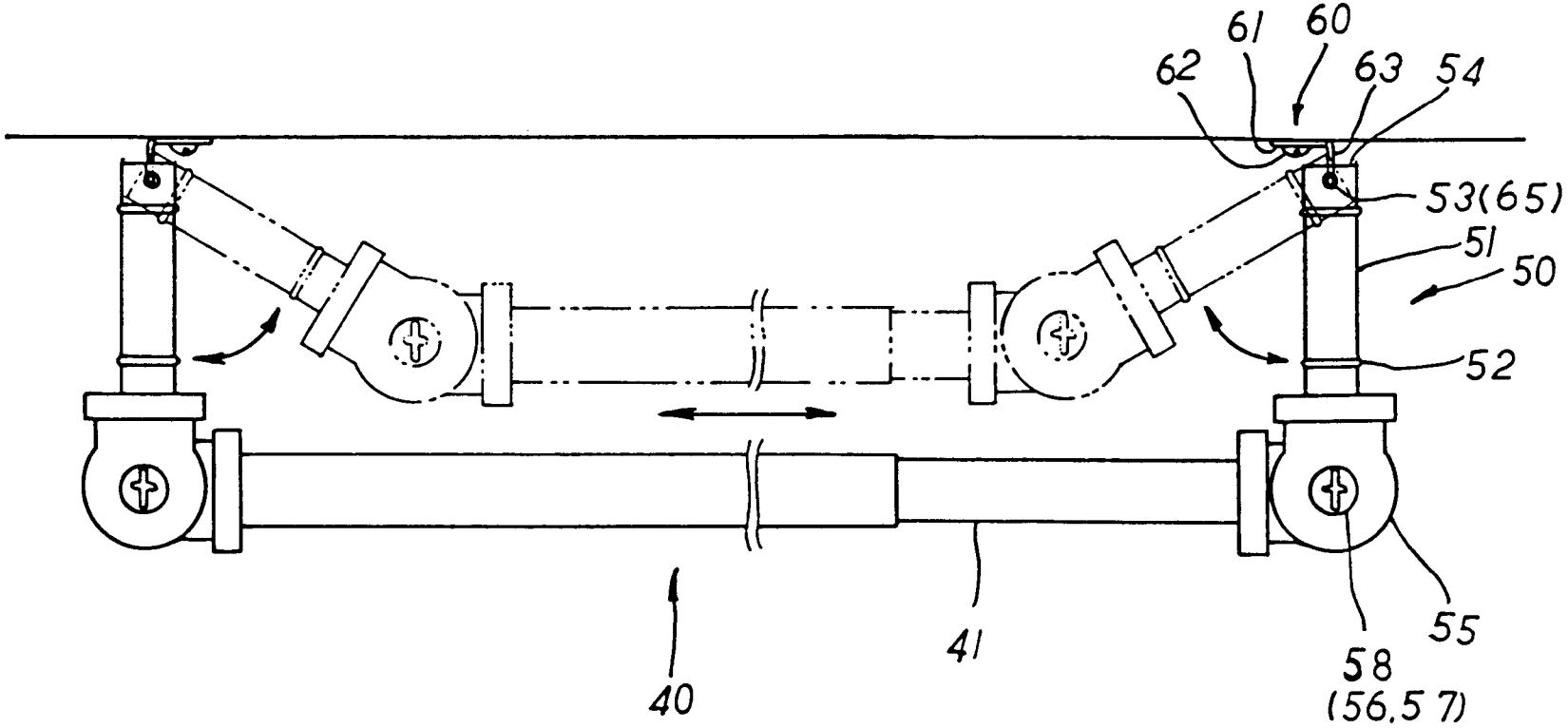
FIG. 5 is atop plan view showing the manner of adjusting the U-shaped curtain rod of the present invention to different service positions.

FIG. 5 shows the manner of adjusting the U-shaped curtain rod of the present invention into different service positions. When a shortened distance between the curtain 30 and the window is desired, simply slightly loosen the screwing members 58 from the threaded holes 57 to allow the two adjusting blocks 55 of each knuckle joint 50 to turn relative to each other. Since each knuckle joint 50 is connected to the mounting plate 60 at one outer connecting arm 51 thereof through rotatable engagement of one round retaining hole 53 with the retaining projection 65, and since the outer connecting arm 51 is pivotally turnable about the retaining projection 65 extending through the round, retaining hole 53, the slightly loosened adjusting blocks 55 and accordingly the inner and outer connecting arms 51 of each knuckle joint 50 could be pivotally pushed laterally inward as shown in FIG. 5. When the two knuckle joints 50 all are turned laterally inward to positions closer to the window, the two tubes 41 of the adjustable rod 40 are further telescoped to reduce an overall length of the adjustable rod 40. After the U-shaped curtain rod has been shifted to a desired position in front of the window, the screwing members 58 are tightened against the threaded holes 57 again to lock the adjusting blocks 55 to each other and hold the knuckle joints 50 and the adjustable rod 40 to the adjusted position.

Reversely, when it is desired to move the U-shaped curtain rod away from the window to increase the distance between the curtain 30 and the window, simply repeat the same steps and push the knuckle joints 50 laterally outward.

With the above-mentioned arrangements, the U-shaped curtain rod of the present invention has the following advantages:

1. The two knuckle joints 50 at two ends of the adjustable rod 40 are easily pivotally movable depending on a user's need. When the user desires to change the distance between the curtain 30 and the window, he or she simply needs to slightly loosen the screwing members 58 from the threaded holes 57 in the adjusting blocks 55 and pivotally push the two outer connecting arms 51 laterally inward or outward, and the adjustable rod 40 automatically adjusts its overall length via the two telescoped tubes 41. After the curtain 30 has been adjusted to the desired position, the screwing members 58 are tightened again to lock the two adjusting blocks 55 to each other and thereby hold the knuckle joints 50 and the adjustable rod 40 to the adjusted position.
2. Since the adjustable rod 40 and the knuckle joints 50 may be adjusted at any time to a position closer to the window to reduce the distance between the curtain 30 and the window, the curtain 30 is not easily wetted by splashed water and the user may handle kitchen works at the sink in a more efficient manner.

The present invention has been described with a preferred embodiment thereof and it is understood that many changes and modifications in the described embodiment can be carried out without departing from the scope and the spirit of the invention as defined by the appended claims.

What is claimed is:

1. A U-shaped curtain rod, comprising:

an adjustable rod, two knuckle joints, and two mounting plates;

said adjustable rod including two telescoping hollow tubes, and two outer ends of said hollow tubes defining two male connectors;

each of said knuckle joints including laterally symmetrical hollow inner and outer connecting arms, two outer ends of the connecting arms comprising two female connectors adapted to tightly be received in respective ones of said male connectors of said adjustable rod, and two laterally symmetrical adjusting blocks connected at outer ends to two inner ends of said two connecting arms and at inner ends to each other; and said adjusting blocks include a plurality of adjusting teeth at contact surfaces therebetween that permit said connecting arms of said knuckle joints to be pivotable with respect to each other; and each of said mounting plates including a fixing base with two mounting holes, and a support bracket extending forwardly from an outer edge of said fixing base at a right angle relative to said fixing base; said support brackets each including a smoothly curved lower front corner having an engaging nose and an upwardly extending upper front corner having a retaining projection adapted to rotatably engage a round retaining hole provided on any of said connecting arms of said knuckle joints such that said knuckle joints are mountable on the mounting plates, so that telescoping movement of said adjustable rod will vary the distance between said adjustable rod and a wall to which said mounting plates are mounted.

2. The U-shaped curtain rod as claimed in claim 1, wherein said outer and inner connecting arms of each of said knuckle joints include outer surfaces with elastic retaining rings.

3. The U-shaped curtain rod as claimed in claim 1, wherein said two adjusting blocks of each of said knuckle joints are two semispherical blocks.

4. The U-shaped curtain rod as claimed in claim 1, wherein said adjusting teeth positioned on said contact surfaces of said two adjusting blocks extend radially.

5. The U-shaped curtain rod as claimed in claim 1 or 2 wherein said connecting arms of said knuckle joints are each provided on upper and lower sides thereof with one of said round retaining holes.

6. The U-shaped curtain rod as claimed in claim 1 or 3, wherein a first one of said two adjusting blocks of each of said knuckle joints includes a centered round hole, and a second one of said two adjusting blocks of each of said knuckle joints is provided with a centered internally threaded hole, and said two adjusting blocks being closely attached to each other at said contact surfaces by a screwing member extending through said round hole into said internally threaded hole.

* * * * *